US005419830A

United States Patent [19]

Chou et al.

[11] Patent Number: 5,419,830

[45] Date of Patent: * May 30, 1995

[54] METHOD FOR CONTROLLING HYDROCRACKING AND ISOMERIZATION DEWAXING

[75] Inventors: Tai-Sheng Chou, Pennington; Nai Y. Chen, Titusville; Grant G. Karsner, Voorhees Township, Camdem County, all of N.J.; Clinton R. Kennedy, Westchester, Pa.; Rene B. LaPierre, Medford, N.J.; Melcon G. Melconian, Princeton, N.J.; Richard J. Quann, Moorestown, N.J.; Stephen S. Wong, Medford, N.J.

[73] Assignee: Mobil Oil Corporation, Fairfax, Va.

[ * ] Notice: The portion of the term of this patent subsequent to Mar. 31, 2009 has been disclaimed.

[21] Appl. No.: 102,675

[22] Filed: Aug. 5, 1993

Related U.S. Application Data

[63] Continuation of Ser. No. 738,991, Aug. 1, 1991, abandoned, which is a continuation-in-part of Ser. No. 279,748, Dec. 5, 1988, Pat. No. 5,100,535, which is a continuation-in-part of Ser. No. 129,951, Dec. 3, 1987, abandoned, which is a continuation of Ser. No. 759,387, Jul. 26, 1985, abandoned.

[51] Int. Cl.[6] ..... C10G 47/36; C10G 47/16

[52] U.S. Cl. ..... 208/111; 208/108; 208/109; 208/110; 208/DIG. 1

[58] Field of Search ..... 208/108, 109, 110, 111, 208/DIG. 1

[56] References Cited

U.S. PATENT DOCUMENTS

| | | | |
|---|---|---|---|
| 3,023,159 | 2/1962 | Ciapetta et al. | 208/111 |
| 3,213,013 | 10/1965 | Arey, Jr. | 208/111 |
| 3,438,887 | 4/1969 | Morris et al. | 208/87 |
| 3,442,794 | 5/1969 | Van Helden et al. | 208/111 |
| 3,523,887 | 8/1970 | Hanson et al. | 208/111 |
| 3,524,807 | 8/1970 | Lewis, Jr. | 208/111 |
| 3,657,110 | 4/1972 | Hengstebeck | 208/89 |
| 3,816,296 | 6/1974 | Hass et al. | 208/111 |
| 3,897,327 | 7/1975 | Ward | 502/66 |
| 3,923,641 | 12/1975 | Morrison | 208/111 |
| 4,158,676 | 6/1979 | Smith et al. | 585/481 |
| 4,251,676 | 2/1981 | Wu | 585/486 |
| 4,300,011 | 11/1981 | Rollmann | 585/467 |
| 4,428,819 | 1/1984 | Shu et al. | 208/46 |
| 4,428,825 | 1/1984 | Ward et al. | 208/109 |
| 4,568,786 | 2/1986 | Hsia Chen et al. | 585/517 |
| 5,100,535 | 3/1992 | Chen et al. | 208/DIG. 1 |

FOREIGN PATENT DOCUMENTS

| | | |
|---|---|---|
| 209208 | 4/1984 | German Dem. Rep. . |
| 1429291 | 3/1976 | United Kingdom . |

*Primary Examiner*—Asok Pal
*Assistant Examiner*—Walter D. Griffin
*Attorney, Agent, or Firm*—Alexander J. McKillop; Dennis P. Santini; Laurence P. Hobbes

[57] ABSTRACT

Nitrogenous compounds especially bases such as ammonia vapor are used to control the operation of a hydrocracker or catalytic dewaxer. Catalyst activity and selectivity may be controlled by addition of the base to the feed, for example, to control the balance between isomerization and hydrocracking in an operation using a zeolite beta catalyst. Runaway conditions may be controlled by the addition of nitrogenous compounds to regulate the temperature profile within the reactor.

5 Claims, 5 Drawing Sheets

METHOD FOR CONTROLLING HYDROCRACKING AND ISOMERIZATION DEWAXING

CROSS-REFERENCE TO RELATED APPLICATIONS

This is a continuation of application Ser. No. 07/738,991, filed Aug. 1, 1991, now abandoned which is a continuation-in-part of application Ser. No. 279,748 filed Dec. 5, 1988, now U.S. Pat. No. 5,100,535 which is a continuation-in-part of application Ser. No. 129,951 filed 3 Dec. 1987, now abandoned, of N. Y. Chen and S. S. Wong which was, in turn, a continuation of application Ser. No. 759,387, filed 26 Jul. 1985, now abandoned. The complete disclosures of Ser. Nos. 279,748 and 129,951 are incorporated in the present application by reference.

FIELD OF THE INVENTION

This invention relates to a method of controlling the operation of a hydrocracker or catalytic dewaxer and, more particularly, to methods for controlling hydrocracking selectivity, stability of hydrocracker operation and reactor exotherms.

BACKGROUND OF THE INVENTION

Hydrocracking is an established process in petroleum refining and in its commercial scale operation zeolite based catalysts are progressively gaining market share because of their higher activity and long term stability. Large pore size zeolites are conventional for this purpose, for example, zeolite X or the various forms of zeolite Y such as ultrastable zeolite Y (USY). Another zeolite which has properties consistent with those and which has been described as having a structure comprising the 12-rings characteristic of large pore size zeolite is zeolite beta and this zeolite has been proposed for use as a hydrocracking catalyst in EP 94827. Zeolite beta is notable for its paraffin-selective behavior. That is, in a feed containing both paraffins and aromatics, it converts the paraffins in preference to the aromatics. This phenomenon is utilized in the hydrocracking process disclosed in EP 94827 to effect dewaxing concurrently with the hydrocracking so that a lower bottoms product pour point is achieved concurrently with a reduction in the boiling range. Another application of the properties of zeolite beta is to dewax petroleum feedstocks by a process of paraffin isomerization, as opposed to the selective paraffin cracking produced by the intermediate pore size zeolites such as ZSM-5. This dewaxing is disclosed in U.S. Pat. No. 4,419,220 and an improvement on the basic zeolite beta dewaxing process is described in U.S. Pat. No. 4,518,485 in which the feedstock is first subjected to hydrotreating in order to remove heteroatom-containing impurities such as sulfur and nitrogen compounds prior to the isomerization reaction. During the hydrotreating process the organic sulfur and nitrogen containing compounds are converted to inorganic sulfur and nitrogen, as hydrogen sulfide and ammonia respectively. Cooling of the hydrotreater effluent and interstage separation between the hydrotreating and dewaxing steps enables the inorganic nitrogen and sulfur to be removed before they pass into the catalytic isomerization/dewaxing zone.

The prior art teaches the addition of nitrogen-containing compounds in dewaxing processes using amorphous or shape-selective zeolite catalysts for various purposes. U.S. Pat. No. 3,657,110 to Hengstebeck et al. discloses a process for hydrocracking nitrogen feedstocks over acidic catalysts such as silica-alumina wherein nitrogen-containing hydrocarbons are added at selected points along the hydrocracking zone so that the nitrogen content of the hydrocarbons in the hydrocracking zone increases in the direction of flow through the hydrocracking zone in order to control the rate of reaction along the hydrocracking zone. U.S. Pat. No. 4,251,676 to Wu discloses a selective cracking process for alkylaromatics which is carried out in the presence of ammonia or organic amines over an intermediate pore size zeolite catalyst. U.S. Pat. No. 4,158,676 to Smith discloses an aromatic isomerization process over shape-selective zeolites which uses added basic nitrogen compounds or their precursors to improve isomerization selectivity. British Patent 1,429,291, discloses a lube hydrocracking process in which various nitrogen-containing compounds may be added to the feed. U.S. Pat. No. 4,428,824 to Ward discloses preparing lubricating oils using a dewaxing or hydrodewaxing process in the presence of added ammonia over shape-selective zeolites such as ZSM-5. U.S. Pat. No. 4,743,354 to Ward teaches a method for preparing hydrodewaxed distillate over a shape-selective zeolite such as ZSM-5 wherein the effluent from a hydrotreater which may contain ammonia is passed to a dewaxer.

From this discussion it is clear that zeolite beta based catalysts may, under appropriate conditions, promote isomerization reactions in preference to cracking reactions or, under other conditions, cracking reactions over isomerization reactions. The balance between the various types of reactions which may occur is dependent upon a number of factors including the composition of the feed and the exact process conditions which may be used. In general, cracking reactions are favored by the use of higher temperatures and more acidic catalysts while isomerization reactions are favored by lower temperatures and the use of a hydrogenation/dehydrogenation component on the catalyst which is relatively active. Thus, isomerization tends to be favored by the use of a catalyst containing a noble metal such as platinum which is highly active for hydrogenation and dehydrogenation reactions, a zeolite which has a moderate acidity and the use of moderate temperatures.

Although these considerations indicate that it would be possible to carry out the desired types of reactions in a selective manner by varying the composition of the catalyst in accordance both with the feedstock available and the desired product, life in the refining industry is rather more difficult outside the laboratory. In a refinery, loading and unloading of catalysts from a reactor is an expensive and time consuming process and is to be avoided if possible. Similarly, feedstocks of the desired composition may not always be available and the product characteristics may change from time to time, depending on the demand for them. Thus, the realities of commercial refining require that a process should be capable of ready adaptation to different feedstocks and different product demands with the minimum of operating changes: in particular, catalyst changes should be avoided if possible. For these reasons, it would be desirable to find some means of modifying the activity and product selectivity of the zeolite beta and other zeolite catalysts so as to modify the yield structure of the catalyst and hence, of the process in which it is being used. If this could be done, it would be possible, for example, to process different feedstocks so as to effect a bulk conversion as well as a dewaxing or, alternatively, to carry out dewaxing by isomerization or to alter the selectivity to distillate or naphtha hydrocracking products. In the first case, waxy gas oils could be hydrocracked and dewaxed at the same time to produce low pour point distillate products such as heating oil, jet fuel and diesel fuel and in the second case, lubricant feedstocks could be selectively dewaxed by isomerization.

Another aspect of the use of zeolite based hydrocracking catalysts such as zeolite beta, zeolite X and zeolite Y which is of some importance in the refining industry is that they have a potential for temperature runaway under adiabatic reaction conditions, which may cause irreversible damage to the cracking catalyst and process equipment. Recent studies have shown that the high activation energy for zeolite-catalyzed hydrocracking process coupled with a relatively high hydrogen consumption, suggests that temperature runaway is highly plausible for a hydrocracker using a zeolite-based catalyst. The potential for harmful unexpected exotherms is particularly great when conditions are changed, e.g., feed composition is altered. In addition, excessive exotherms may arise under steady state conditions: the temperature at some point in the reactor-usually the back end, may be stable but too high for the desired degree of selectivity or cycle length.

Currently available schemes for controlling temperature runaway utilize quench hydrogen to lower the reactor temperature in the high temperature stage. Hydrogen quench is effective for a normal operation with minor adjustment of reactor temperature but under potential temperature runaway situations hydrogen quench may be disastrous. This is partially due to the injection of additional hydrogen to the "hydrogen starvation" temperature runaway zone. Another factor which has often been ignored is the wrong way behavior, resulting from the differences in the creeping velocity between mass and heat transfer waves. See "Chemical Reactor Design and Operation," Westerterp, Van Swaaij, and Beenackers, John Wiley & Sons, 1984. The injection of the quench hydrogen reduces the temperature and conversion near the inlet of the potentially dangerous stage. Under normal conditions, heat waves travel slower than mass waves. Consequently, the high temperature zone, which normally appears near the outlet of the stage for an adiabatic reactor, may be fueled with unconverted hydrocarbons entrained from the quenched zone. Eventually, the reactor will attain its lower temperature steady state. However, this dynamic response of the wrong way behavior using hydrogen quench may potentially induce irreversible deactivation for the cracking catalyst, e.g., sintering of the metal hydrogenation component. Damage to the process equipment, e.g., reactor and heat exchanger, resulting from the wrong way behavior, is possible. For this reason some alternative method of controlling hydrocracker operation including, in particular, temperature excursions, is desirable.

SUMMARY OF THE INVENTION

It has now been found that nitrogen compounds may be used to control catalyst activity, product selectivity and to control thermal behavior in an adiabatic reactor. In a particular application, it has been found that the selectivity of zeolite beta for isomerization may be improved by adding nitrogen containing compounds to the feedstock before or during the processing. This result is unexpected because it is known that nitrogen containing compounds are well known to be detrimental for the performance of zeolite catalysts. The selectivity for isomerization is reversible merely by discontinuing the cofeeding of the nitrogen containing compound so that if cracking performance should be desired again, it can be regained by reverting to operation without the nitrogen compound. Selectivity may be controlled in this way so as to maintain the desired product distribution: with lube boiling range materials, isomerization selectivity may be maintained at a desired high level to dewax without cracking out of the lube boiling range; in other applications, less isomerization selectivity may be required so as to isomerize and hydrocrack the feed to middle distillates but without overcracking; finally, isomerization selectivity may be minimized if the feed is to be hydrocracked all the way to naphtha. Appropriate adjustment of the amount of nitrogen compounds admitted to the reactor will enable the selectivity to be varied in this way.

According to the present invention, therefore, there is provided a method for controlling the operation of a hydrocracking process by the addition of a nitrogen compound or a precursor of such a compound to the hydrocracker feed or to the reactor. Suitable nitrogen compounds for this purpose include basic compounds such as amines, basic heterocyclic nitrogen compounds. In addition, nitrogen-containing petroleum refinery streams may also be used to provide the nitrogenous compounds, usually in the form of nitrogen-containing heterocyclic compounds, to control the operation of the hydrocracker.

In the application of the process to the control of isomerization and hydrocracking over zeolite beta, the feedstock is isomerized by contact with zeolite beta under isomerization conditions with a requisite amount of the nitrogen compound in the feed to control the activity and selectivity of the catalyst for isomerization of the waxy paraffins. If reversion to less selective isomerization performance is desired i.e. more hydrocracking with a greater degree of conversion to lower boiling product, it suffices merely to cease the cofeeding of the nitrogen containing compound and after a brief period of time, the former activity of the catalyst for non-isomerization reactions is regained.

The addition of nitrogen compounds at intervals along the length of the reactor may be useful for control of the temperature profile in the reactor as well as for maintaining stable operation. Provision for maintaining stable operation under conditions creating a potential for temperature runaway, e.g., feedstock change or perturbation of the feed preheat furnace, are significant safety and cost effective features of the invention. The injection of nitrogen-containing compounds to the inter-bed quench zones is capable of causing a rapid decrease in cracking rate, resulting in well-controlled reactor operation.

In another embodiment, the present invention relates to a method of controlling the stability of an isomerization dewaxing process in which a waxy hydrocarbon fraction is contacted under dewaxing conditions with a zeolitic dewaxing catalyst comprising zeolite beta in a dewaxing reactor having an inlet and an outlet. This embodiment comprises injecting ammonia vapor into the reactor to contact the catalyst in amounts sufficient to prevent temperature runaway or maintain operating temperatures in said dewaxing reactor below 900° F. (482° C), i.e., temperatures at which the dewaxing catalyst sustains damage. This embodiment is particularly useful where the dewaxing catalyst inventory comprises noble metals whose hydrogenation/dehydrogenation function is related to sufficient dispersion throughout the catalyst. Failure of the feed pump or upset of the reactor feed furnace can result in temperature runaway which results in operating temperatures high enough to damage the dewaxing catalyst.

The injection of ammonia vapor to control reaction rate during incipient runaway conditions has been found to be extremely effective in isomerization dewaxing processes which exhibit high apparent activation energy. The presence of ammonia in the vapor phase allows a quick response of the catalyst surface throughout the isomerization reactor due to the short residence time of the vapor phase as opposed to liquid phase materials, e.g., liquid quench or bulky nitrogen compound injection.

Sample calculations for the response time (or residence time) between vapor and liquid phases obtained from a commercial catalytic isomerization dewaxing unit of 12,000 BPD are described as follows:

| | Reactor Inlet | Reactor Outlet |
|---|---|---|
| Vapor flow rate, $M^3$/hr | 2497 | 2661 |
| Liquid flow rate, $m^3$/hr | 113.1 | 108.0 |
| Reactor volume, $m^3$ | | |
| Vapor volume | 22.8 | 24.2 |
| (Vapor void fraction) | 0.200 | 0.212 |
| Liquid volume | 67.8 | 66.4 |
| (Liquid void fraction) | 0.594 | 0.582 |
| Residence time, min | | |
| Vapor | 0.55 | 0.55 |
| Liquid | 36.0 | 36.9 |

DRAWINGS

DETAILED DESCRIPTION

Figure 1A:
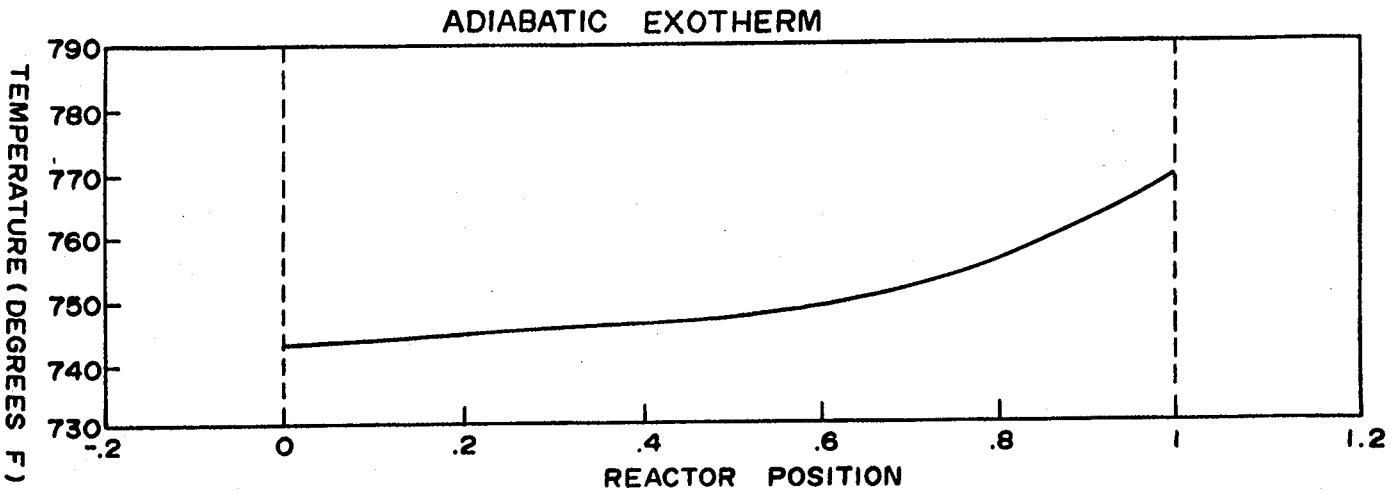
FIG. 1A is a graph showing the temperature profile along a hydrocracking reactor and FIG. 1B shows the corresponding nitrogen profile.
Figure 1B:
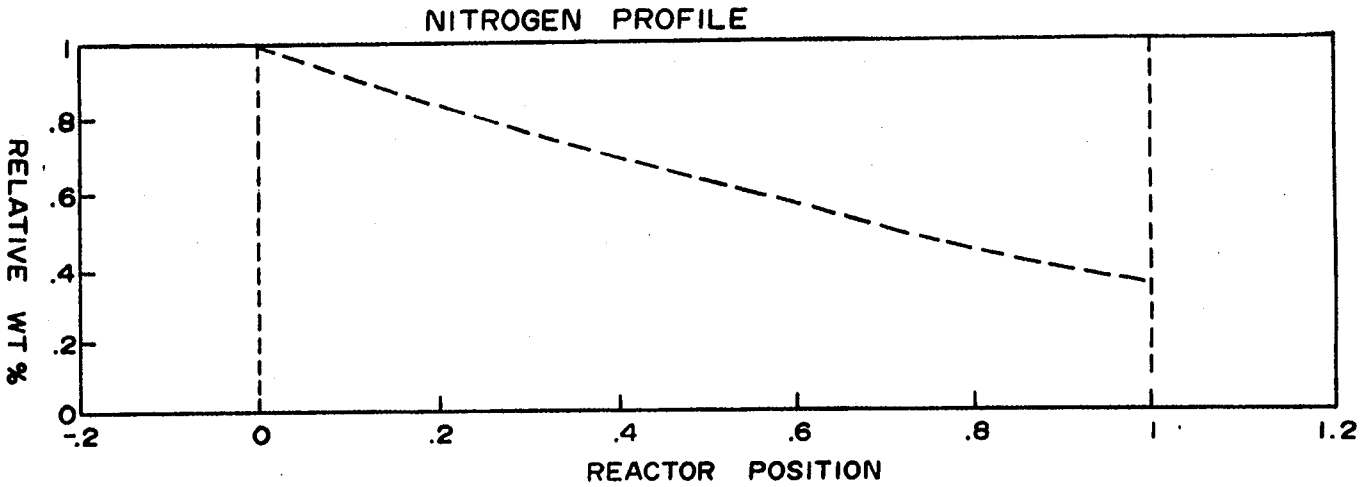

As described above, zeolite-based hydrocracking catalysts are becoming more commonly used because of their advantages, especially higher activity and long term stability. However, they suffer the disadvantage of being prone to undesirable temperature runaways which may, in fact, be exacerbated by the use of the hydrogen quench which is commonly used to control the temperature profile within the reactor. An example of a reactor exotherm is shown in FIG. 1A. The figure shows the temperature profile axially along the reactor and shows that temperature increases from inlet to outlet as a result of the release of heat from the exothermic reactions which take place in the reactor. Although partly balanced by the endothermic cracking reactions which also occur during the hydrocracking the process is net exothermic with the result that a temperature profile similar to the one in the figure results. The temperature profile correlates inversely with the organic nitrogen profile shown in FIG. 1B. As the organic nitrogen content of the charge is reduced by the hydrocracking reactions taking place progressively along the reactor, the nitrogen content decreases proportionately and, accordingly, the catalyst becomes progressively more acidic in character. The magnitude and configuration of the exotherm will vary according to the nature of the catalyst and other reaction parameters. The exotherm is related to the hydrogen consumption which, for zeolitic hydrocracking catalysts, is no greater than that of amorphous catalysts; recent studies have shown that zeolite catalysts may exhibit reduced exotherms compared to non-zeolite (amorphous) catalysts but the potential problem with zeolitic catalysts nevertheless exists, arising from their high activation energies.

The zeolite catalysts used in hydrocracking are typically large pore size zeolites such as zeolites X and Y, especially USY. Other zeolites having large pore size structures may also be employed for example, ZSM-4 or ZSM-20. Zeolite beta may, as described below, also be employed, especially in one specific type of operation where catalyst activity and selectivity are to be controlled as well as the reactor temperature profile. The large pore size zeolites may be accompanied by other zeolites especially the intermediate pore size zeolite such as ZSM-5.

The zeolite is usually composited with an active or inert binder such as alumina, silica or silica-alumina. Zeolite loadings of 20 to 90 weight percent are typical, usually at least about 50 percent zeolite, e.g., 50–65 weight percent.

A metal hydrogenation component is also present as is conventional for hydrocracking catalysts. It may be a noble metal such as platinum or palladium or, more commonly, a base metal, usually from Groups VA, VIA or VIIIA of the IUPAC Periodic Table, e.g., nickel, cobalt, molybdenum, vanadium, tungsten. Combinations of a Group VA or VIA metal or metals with a Group VIIIA metal are especially favored, e.g., Ni—W, Co—Mo, Ni—V, Ni—Mo. Amounts of the metal are typically about 5–20% for the base metals and less, e.g., 0.5%, for the more active noble metals. Typically, the catalyst comprises 0.01 to 2 wt % of noble metal, e.g., platinum, preferably 0.1 to 1 wt %. The metal component may be incorporated by conventional methods such as ion exchange onto the zeolite or impregnation.

Processing conditions are generally conventional. Reactor inlet (feed) temperatures are typically from about 500° to 900° F. (about 260° to 480° C.), more usually about 550° to 800° F. (about 288° to 427° C.), hydrogen pressures typically of 400 to 4000 psig (about 2860 to 27680 kPa abs), more usually about 400 to 2000 psig (2860 to 13840 kPa), circulation rates of 1000 to 4000 SCF/Bbl (about 180 to 720 n.l.l.$^{-1}$) and space velocities of 0.25 to 10, usually 0.5–2.0 hr.$^{-1}$ LHSV.

As described above, hydrocracking under these conditions will typically result in a positive temperature gradient along the axis of the reactor as shown in FIG. 1A. To maintain this exotherm within tolerable limits, a basic organic nitrogen compound or ammonia vapor is added at the reactor inlet or along the length of the reactor. As the feed passes through the reactor organic nitrogen contained in it is converted to inorganic nitrogen (ammonia) which is less tightly bound to the active sites on the zeolite under the temperatures prevailing in the reactor. In order to control the exotherm at the point where the greatest temperature excursions are most likely i.e. at the back end of the reactor, additional quantities of nitrogen compound are added at the reactor inlet or along the length of the reactor between the inlet and the outlet. Injection preferably takes place at at least one point along the reactor axis, from the inlet to the outlet. Multiple injection points may be provided if desired for closer control of the exotherm, e.g., at 25%, 50%, 60%, 75% along the length of the reactor, or wherever necessary for effective control of the temperature profile. The acceptable limit on the exotherm may vary according to a number of factors including the character of the process equipment, e.g., reactor and heat exchanger metallurgy, reactor control system, catalyst character, e.g., metal component, resistance to sintering, or feed composition. The 27° F. exotherm of FIG. 1A may, in some instances, be considered acceptable but changed circumstances might render it marginal in character. The exact magnitude of the exotherm should therefore be determined as the situation requires.

Figure 2A:
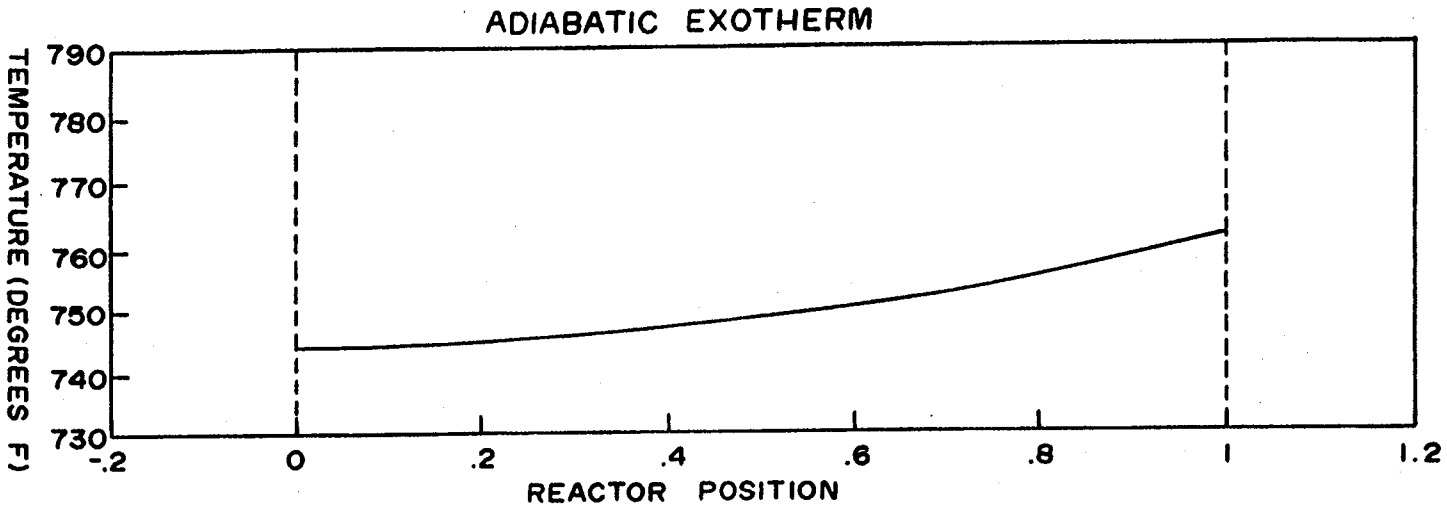
FIGS. 2A and 2B show the corresponding temperature and nitrogen profiles with nitrogen compound injection.
Figure 2B:
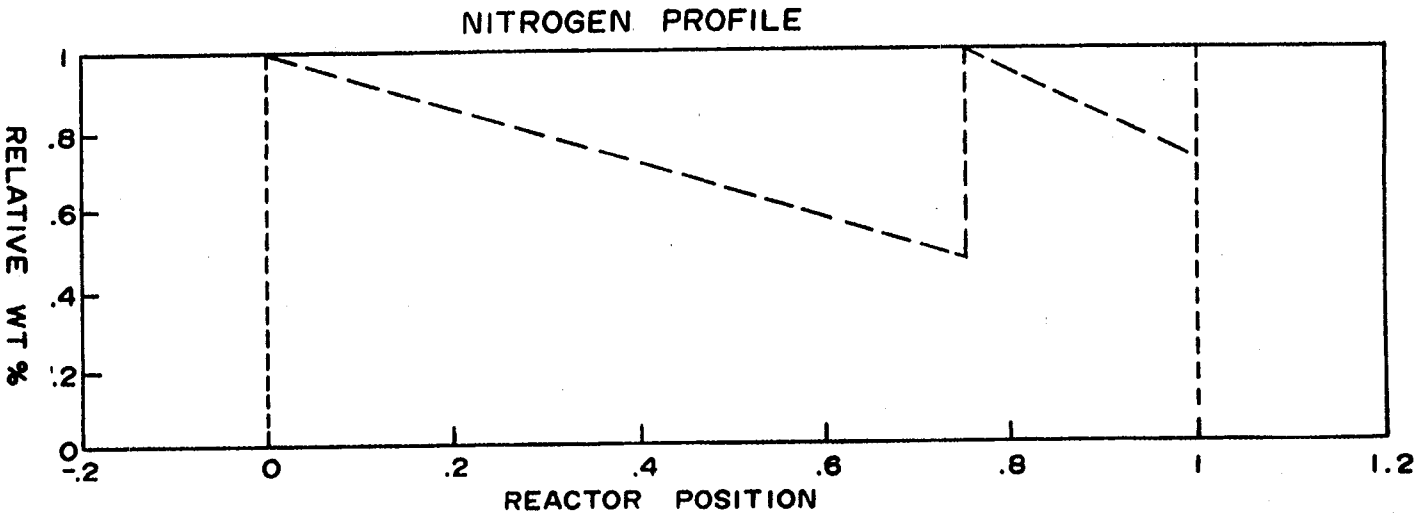

The injection points may be disposed along the reactor in a manner which counteracts the removal of nitrogen during the hydrocracking. FIG. 2A shows a typical exotherm and FIG. 2B the corresponding organic nitrogen profile (based on kinetic model calculations) with injection of basic nitrogen three quarters (75%) along the axial length of the reactor. By suitable choice of injection position(s) a relatively flatter profile can be achieved.

The nitrogenous compound may also be cofed with the feedstock for control of selectivity and catalyst activity so that the feedstock and the nitrogenous compound contact the catalyst simultaneously during the reaction. When nitrogenous compound is cofed with the feed, it may be added to the feedstock before it is fed into the hydrocracker unit or, alternatively, the feedstock and the nitrogenous compound may be metered separately into the unit, with due care being taken to ensure that the nitrogenous compound will be well distributed throughout the reactor in order to ensure that its effect is brought to bear upon all the catalyst. When the compound is to be employed for catalyst selectivity control, it will generally be preferred to add the nitrogenous compound to the feedstock prior to entry into the reactor because this will ensure good distribution of the nitrogen compound.

The use of nitrogen compounds may also be desirable for the control of runaway conditions, for example, when the temperature at any point in the reactor increases by at least 100° F./hr (about 56° C. $hr^{-1}$). If this is found to occur, basic nitrogenous compounds such as those described below may be injected at one or more appropriate points in the reactor to reduce catalyst activity so that the temperature reverts to normal. Injection between the beds is advantageous in order to maintain the best control over reactor temperature profile and operational stability. Once equilibrium has been restored, the injection of the nitrogen compound can be terminated and operation resumed as before.

Nitrogenous Compounds

The nitrogen-containing compounds which may be used in the present process should be ones which neither react with the charge material to a significant extent nor possess catalytic activity which would inhibit the desired reactions. The nitrogen-containing compounds may be gaseous, liquid or in the form of a solid dissolved in a suitable solvent such as toluene.

The nitrogenous compounds which are used are basic, nitrogen-containing compounds including ammonia, organic nitrogen-containing compounds, e.g., the alkyl amines, specifically the alkyl amines containing from 1 to 40 carbon atoms and preferably from 5 to 30, e.g., 5 to 10 carbon atoms such as alkyl diamines of from about 2 to 40 carbon atoms and preferably from 6 to 20 carbon atoms, aromatic amines from 6 to 40 carbon atoms such as aniline and heterocyclic nitrogen-containing compounds such as pyridine, pyrolidine, quinoline and the various isomeric benzoquinolines. If the compound contains substituents such as alkyl groups, these may themselves be substituted by other atoms or groups, for example, halo or hydroxyl groups as in ethanolamine and triethanolamine, for example.

An alternative is to use cofeeds which themselves contain nitrogen compounds which will have the desired effect on catalyst activity. Such cofeeds may be injected into the reactor at appropriate positions as described above and besides providing the desired operational control will participate in the hydrocracking themselves.

The amount of nitrogen-containing compound which is actually used will depend upon a number of factors including the composition of the feedstock, the extent to which it is desired to modify catalytic activity and also upon the nature of the catalyst, particularly its acidity as represented by the silica:alumina ratio. Other constraining factors such as the desired operating temperature may also require the amount of the nitrogenous compound to be adjusted in order to obtain the desired results. Therefore, in any given situation, it is recommended that the exact amount to be used should be selected by suitable experiment prior to actual use. Because the reaction is reversible, the use of excessive amounts of the nitrogen-containing compound will not usually produce any undesirable and permanent effect on the catalyst although coking deactivation may occur. However, as a general guide, the amount of organic nitrogen-containing compound used will generally be in the range of 1 ppmw to 1.0 wt. percent, preferably 10 to 500 ppmw of the feedstock when used in steady state addition either for activity or selectivity control with its consequent effect on the steady state exotherm. For control of runaway conditions, more may be used, according to the magnitude of the condition. In one embodiment of the present invention, ammonia vapor is added at levels greater than 500, 1000 or even 1500 ppm in the hydrocarbon feedstock, based on the steady state rate of feed to the reactor.

The addition of nitrogen compound, e.g., ammonia vapor, to the catalytic dewaxing reactor to prevent temperature runaway can be automatically controlled by various parameters. In one embodiment, said injection is controlled by monitoring the exotherm rate of increase and effecting nitrogen compound injection when a set rate of increase is exceeded, e.g., 50° F., 100° F. or even 150° F., per hr. The setting used is generally dependent on individual reactor and catalyst characteristics as well as operating experience. Another way of controlling the addition of nitrogen compound to the reactor is to make it a function of critical parameters such as feed pump output or feed heater outlet temperature. For example, ammonia vapor can be added in response to a decrease in the feed rate of waxy hydrocarbon to the dewaxing reactor.

Selectivity Control

As described above, a particular application of the present process is in the control of a hydrocracking/isomerization process using a zeolite beta catalyst. The objective in this instance is to enable the isomerization performance of the zeolite beta based catalyst to be improved in situations when this is desired. This may be necessary, for example, when working with a feedstock whose composition is relatively unfavorable for isomerization performance, where the catalyst in use is one which would generally favor cracking (including hydrocracking) activity over isomerization or in cases where the operating conditions which have to be employed would otherwise disfavor isomerization, for example, high temperatures or relatively low hydrogen pressure. In general, cracking activity is favored by high temperatures, relatively more acidic catalysts; conversely, isomerization is favored by lower temperatures, less acidic catalysts and more active metal components such as platinum. Therefore, if a commercial scale refining unit has been set up for a hydrocracking-/dewaxing of the kind described in EP 94827 and its corresponding U.S. Ser. No. 379,421, with a relatively acidic catalyst and a metal component of relatively low hydrogenation/dehydrogenation activity, it will generally be undesirable to attempt to carry out isomerization/dewaxing using such a unit because even if operating conditions such as temperature and hydrogen pressure could be adjusted in favor of isomerization, the acidity of the zeolite and the low activity of the metal could not be adjusted without unloading the catalyst and reloading with fresh catalyst. However, by cofeeding a nitrogenous compound with the feed, isomerization selectivity can be enhanced, thereby enabling the unit to be used and adapted in diverse operations, as circumstances may require.

As mentioned above, cracking activity is favored by the more highly acidic zeolites and these are generally characterized by a relatively low silica:alumina ratio. Hence, acidic activity is related to the proportion of tetrahedral aluminum sites in the structure of the catalyst. Because the objective in the present process is to inhibit the cracking activity relative to the isomerization activity, the use of the nitrogenous compounds will be of greatest benefit with very clean feeds and with the more highly acidic forms of zeolite beta, that is, with the forms which have the lower silica:alumina ratios. (The silica:alumina ratios referred to in this specification are the structural or framework ratios, as mentioned in U.S. Pat. No. 4,419,220, to which reference is made for an explanation of the significance of this together with a description of methods by which the silica:alumina ratio in the zeolite may be varied). As described in U.S. Pat. No. 4,419,220, the isomerization performance of the zeolite is noted at silica:alumina ratios of at least 30:1 and generally, ratios considerably higher than this are preferred for best isomerization performance, for example, silica:alumina ratios of at least 100 to 1 or higher, e.g., 200:1 or 500:1. Generally, the use of the nitrogen compounds will be preferred with the forms of zeolite beta which have silica:alumina ratios below about 100:1 and particularly, below 50:1, e.g., 30:1.

The isomerization/hydrocracking process may be used with a variety of feedstocks and depending upon the feedstock and the type of product which is to be produced, either isomerization/dewaxing may be carried out or hydrocracking/dewaxing. Thus, if the objective is to dewax a feedstock while minimizing the bulk conversion, the process will be particularly useful with waxy distillate stocks such as kerosenes, jet fuels, lubricating oil stocks, heating oils and other distillate fractions whose pour point (ASTM D-97) needs to be maintained within certain limits. Lubricating oil stocks will generally boil above about 230° C. (about 445° F.) and more usually above about 315° C. (about 600° F.) and in most cases above about 345° C. (about 650° F.). Other distillate fractions will generally boil in the range 165° C. to 345° C. (about 330° to 650° F.). Feedstocks having an extended boiling range, e.g., whole crudes, reduced crudes, gas oils and various high boiling stocks such as residual and other heavy oils may also be dewaxed by the present isomerization process although it should be understood that its principal utility will be with lubricating oil stocks and distillate stocks and light and heavy gas oils, as described in U.S. Pat. No. 4,419,220 to which reference is made for a more detailed description of the applicable feedstocks.

The zeolite beta catalyst is preferably used with a hydrogenating-dehydrogenating component, as described in U.S. Pat. No. 4,419,220 to which reference is made for a detailed description of these catalysts together with methods for preparing them. As mentioned above, the use of the nitrogen compounds is particularly preferred with the more acidic forms of the zeolite, namely, where the silica alumina ratio is less than about 100:1, e.g., 50:1 or 30:1. Also, because the metal components which are more active for hydrogenation and dehydrogenation are the noble metals, particularly platinum and palladiums the noble metals are preferred as the hydrogenation/dehydrogenation components as these will favor isomerization activity. The amount of noble metal on the catalyst will generally be from 0.01 to 10 percent by weight and more commonly in the range 0.1 to 5 percent by weight, preferably 0.1 to 2 percent by weight. However, base metal hydrogenation/dehydrogenation components such as cobalt, molybdenum, nickel, and base metal combinations such as cobalt-molybdenum and nickel-tungsten may also be used as described above although it may be necessary to use relatively greater amounts of these metals. As mentioned in U.S. Pat. No. 4,419,220, the catalyst may be composited with another material as matrix to improve its physical properties and the matrix may possess catalytic properties, generally of an acidic nature.

The process conditions employed in this case will be those which favor isomerization and although elevated temperatures and pressures will be used, the temperature will be kept towards the low end of the range in order to favor isomerization over cracking which takes place more readily at the higher temperatures within the range. Temperatures will normally be in the range from 250° to 500° C. (about 480° to 930° F.), preferably 280° to 450° C. (about 536° to 840° F.) but temperatures as low as about 200° C. may be used for highly paraffinic feedstocks, especially pure paraffins. Pressures will generally range from atmospheric up to about 25,000 kPa (about 3610 psig) and although higher pressures are preferred, practical considerations will generally limit the pressure to a maximum of about 15,000 kPa (2160 psig) and usually, pressures in the range of 2500 to 10,000 kPa (350 to 1435 psig) will be satisfactory. Space velocity (LHSV) is generally from 0.1 to 10 $hour^{-1}$, more usually 0.2 to 5 $hour^{-1}$. Isomerization is preferably conducted in the presence of hydrogen both to reduce catalyst aging and to promote the steps in the isomerization reaction which are thought to proceed from unsaturated intermediates and if additional hydrogen is present, the hydrogen:feedstock ratio is generally from 200 to 4000 n.l.l.$^{-1}$ (about 1125 to 22470 scf/bbl), preferably 600 to 2000 n.l.l.$^{-1}$ (3370 to 11235 scf/bbl).

Process conditions for the isomerization are therefore, in general, the same as those described in U.S. Pat. No. 4,419,220 and other aspects of the process and suitable operating conditions are described in greater detail in U.S. Pat. No. 4,419,220, to which reference is made for a description of these details.

Example 1

In order to demonstrate the effect of the addition of nitrogenous compounds to the feed, hexadecane was selected as a model feed and was passed over a catalyst comprising 0.6 wt. percent platinum on zeolite beta. The zeolite beta was used in its as synthesized condition, having a silica:alumina ratio of 30:1. Temperatures varying from 200° to 400° C. were used, at a total pressure of 3550 kpa (500 psig) and space velocities of 1.0 hr.$^{-1}$. Hydrogen circulation rate was 712 n.l.l.$^{-1}$ (4000 SCF/bbl. The temperature was adjusted to give varying severities in order to demonstrate how isomerization and cracking activity could be varied relative to one another. Total zeolite activity, mainly by isomerization and cracking was monitored by measuring disappearance of n-hexadecane. Isomerization activity was measured by the appearance of iso-hexadecanes in the product. All determinations were made by vapor phase chromatography.

Figure 3:
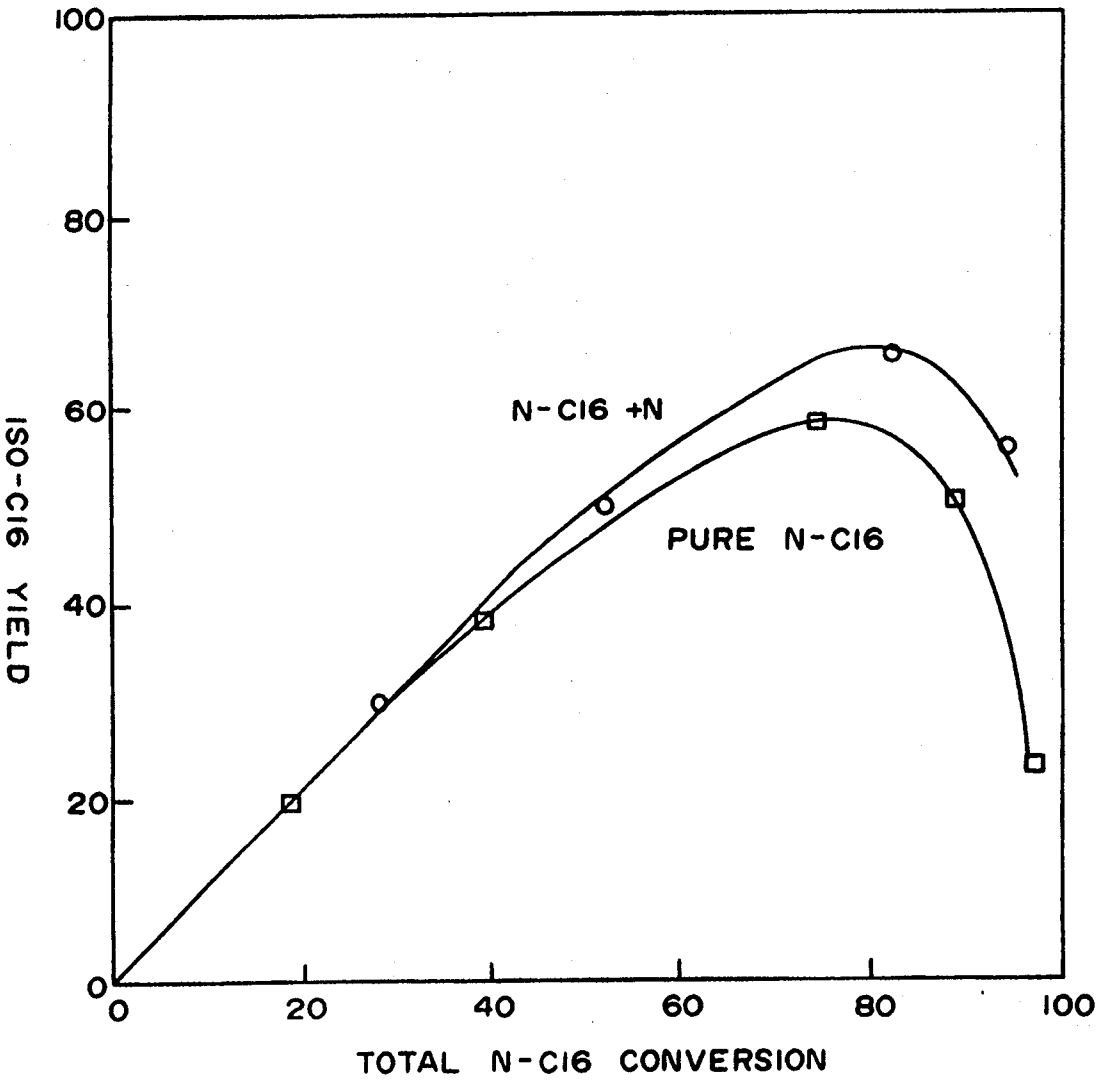
FIG. 3 is a graph relating to isomerization and conversion of a model compound in the presence and absence of a nitrogenous base.

The results are shown in FIG. 3 of the drawings which relates the proportion of iso-hexadecanes in the product to the total conversion of hexadecanes. Thus, as the total conversion increases, hexadecane is removed from the feed by isomerization and cracking, with the isomerization activity indicated by the appearance of iso-hexadecanes in the product. Thus, with a feed consisting of pure n-hexadecane, the conversion of the paraffin at low severities below about 30% is almost totally by isomerization. At severities between about 30% and 70%, a degree of cracking occurs, so that the disappearance of n-hexadecane from the feed is not matched quantitatively by the appearance of iso-hexadecanes in the product, with the difference becoming more marked towards higher conversions. At higher conversions above about 70% the yield of iso-hexadecanes decreases as the isomerization products are also subjected to cracking. This is shown by the lower curve in FIG. 1.

If, however, a nitrogenous compound, here, 5,6-benzoquinoline, in an amount of 0.02 weight percent, is added to the feed, the amount of iso-hexadecanes is relatively greater, as shown by the upper curve in the figure, with the decrease in the isoparaffinic product being noted at a relatively higher conversion of about 85%. This indicates that the presence of the nitrogen compound inhibits cracking and therefore relatively favors isomerization at otherwise comparable reaction conditions.

Example 2

Figure 4:
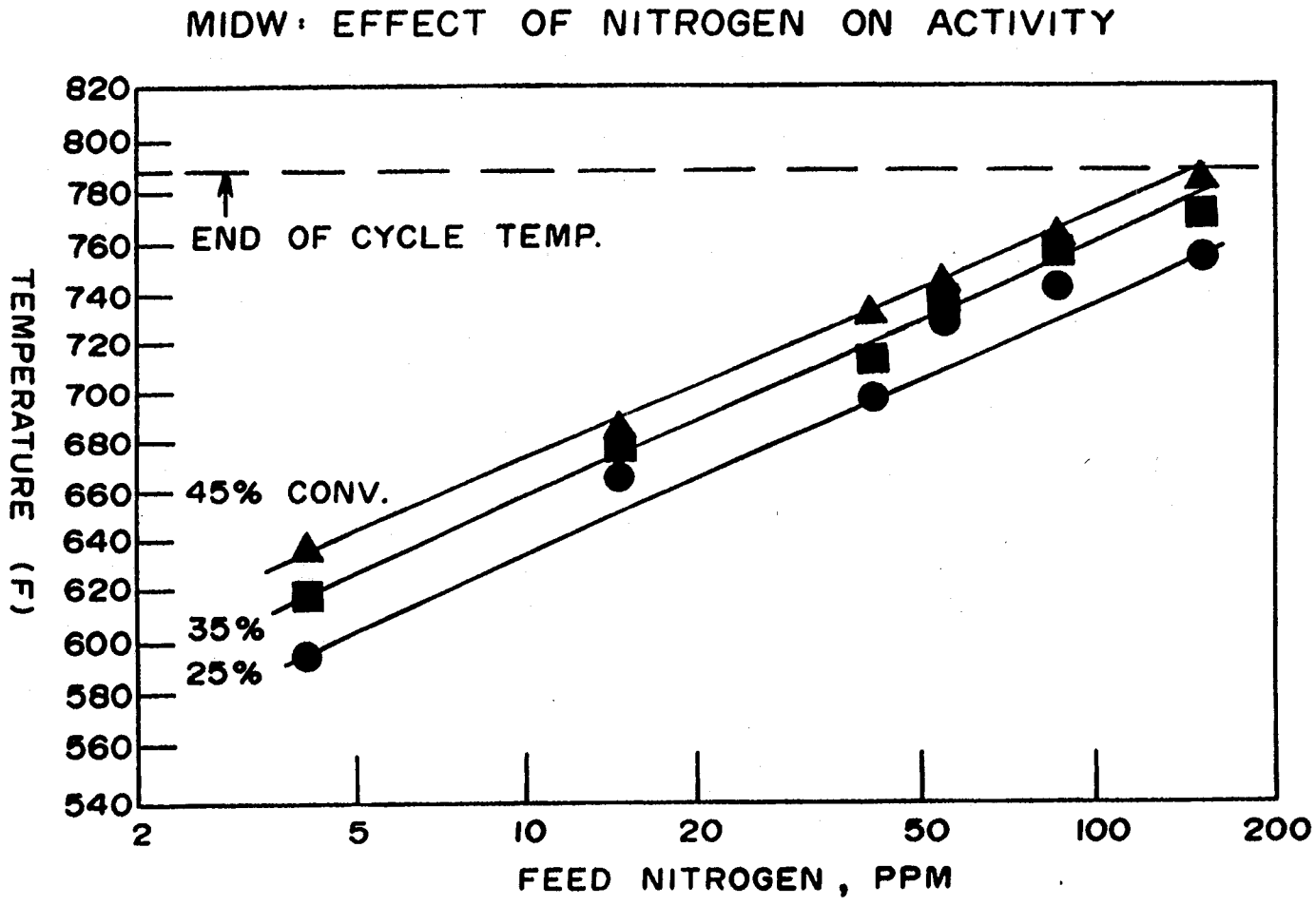
FIG. 4 is a graph showing the effect of feed nitrogen on catalyst activity.

Six different feeds hydrotreated to varying nitrogen contents from 4 to 150 ppmw nitrogen were charged to a hydrocracker/isomerizer and passed over a Pt/zeolite beta catalyst at varying temperatures to obtain 650° F.+ conversions of 25%, 35% and 45% (conversion of the 650° F.+ fraction of the feed converted to 650° F.− products). The results are shown in FIG. 4. The reaction is shown to be sensitive to nitrogen content and is related semi-logarithmically to the nitrogen content.

Example 3

A raw gas oil feed was hydrocracked over three different mild hydrocracking catalysts each containing a nickel-tungsten metal component to produce a 730° F.+ (387° C.+) bottoms fraction. The conditions used and the properties of the 730° F.+ bottoms products are given in Table 1 below.

TABLE 1

| | VGO Hydrocracking | | |
|---|---|---|---|
| Catalyst | Beta | REX/ $SiO_2$—$Al_2O_3$ | Amorphous |
| Catalyst | | | |
| Operating Pressure, psig. | 1000 | 1200 | 1200 |
| LHSV, Hr$^{-1}$ | 0.5 | 0.5 | 0.5 |
| Temperature, °F. | 730 | 745 | 750 |
| Conversion, % 730° F.+ | 35 | 35 | 35 |
| Bottoms Properties | | | |
| Gravity, API | 32.6 | 35.3 | 34.2 |
| Nitrogen, ppmw | 53 | 14 | 40 |
| Sulfur, wt. pct. | 0.1 | 0.1 | 0.1 |
| Pour Point, °F. | 100 | 115 | 105 |
| P | 38.4 | 49.2 | 50.1 |
| N | 37.1 | 38.4 | 30.2 |
| A | 24.5 | 12.4 | 19.8 |

Figure 5:
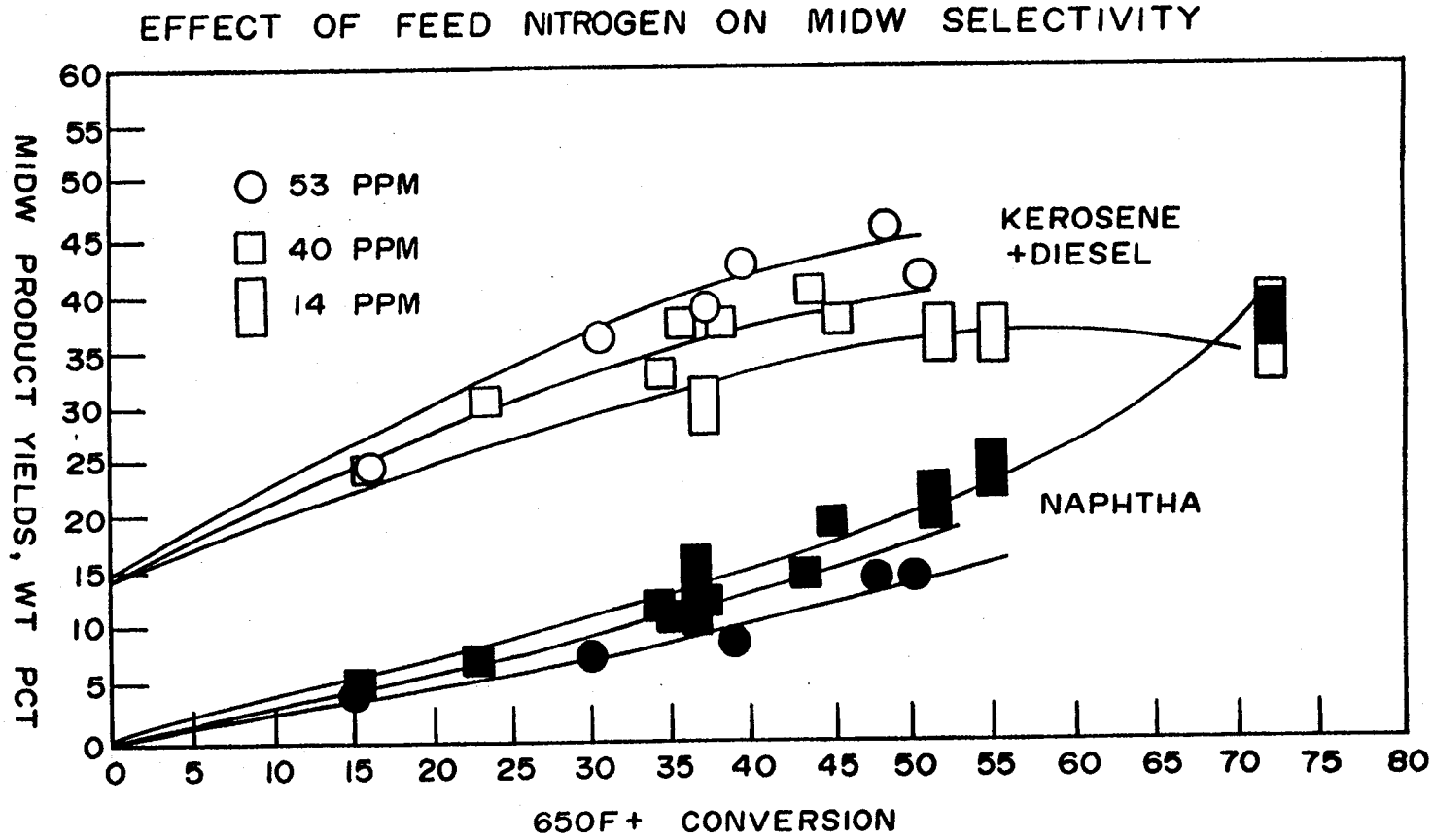
FIG. 5 is a graph showing the effect of feed nitrogen on catalyst selectivity.

These hydrocracked bottoms products were then hydroprocessed over a Pt/zeolite beta catalyst (0.6% Pt) at 400 psig, 1.0 LHSV (2860 kPa abs, 1.0 hr$^{-1}$), using varying temperatures to obtain different conversion levels. The results, shown in FIG. 5, indicate that there is a clear and significant shift from naphtha to middle distillate products with increasing nitrogen content of the feed.

Example 4 (Comparative)

A three-bed isomerization dewaxing unit of 12,000 BPD using zeolite beta with 0.6 wt % Pt dewaxing catalyst experienced 18 minutes feed pump failure. The reactor was dependent on conventional liquid quench to control reaction exotherms. Twenty-five minutes after the pump failure, top bed temperature increased from 325° to 378.8° C. Cascade process control was reverted to direct quench liquid to the top bed. Reactor top bed temperature was slowly lowered to the desirable range.

Example 5

The three-bed isomerization dewaxing unit of 12,000 BPD in Example 4 again experienced feed pump failure. An immediate increase in ammonia vapor injection to each of the three beds (to 100 kg/h overall, i.e., 1500 ppm $NH_3$ based on steady state hydrocarbon feed rate) coupled with quench flow increase to the top bed completely eliminated the possibility for temperature rise. The effectiveness of ammonia vapor injection in the dewaxing reactor for temperature excursion control is attributable to the speedy transport of ammonia in the vapor phase (0.55 minute residence time vs. 36 minutes residence time in the liquid phase).

We claim:

1. A method of controlling the operation of a hydrocracking process in which a hydrocarbon fraction is contacted under hydrocracking conditions in the presence of hydrogen, at reactor inlet temperatures of 500° to 900° F. (200° to 480° C.) and hydrogen pressures of 400 to 4000 psig (2860 to 27680 kPa), with a zeolite hydrocracking catalyst comprising zeolite beta in a hydrocracking reactor having an inlet and an outlet, the method consisting essentially of injecting ammonia separately in amounts ranging from 200 to 500 ppmw of said hydrocarbon fraction into the reactor to contact the catalyst along the length of the reactor between the inlet and the outlet to control the temperature profile within the reactor.

2. A method of controlling the stability of a hydrocracking process in which a hydrocarbon fraction is contacted under hydrocracking conditions in the presence of hydrogen, at reactor inlet temperatures of 500° to 900° F. (200° to 480° C.) and hydrogen pressures of 400 to 4000 psig (2860 to 27680 kPa), with a zeolitic hydrocracking catalyst comprising zeolite beta in a hydrocracking reactor having an inlet and an outlet, the method consisting essentially of injecting ammonia into the reactor in amounts greater than 500 ppm of said hydrocarbon fraction along the length of the reactor between the inlet and the outlet to contact the catalyst to reduce an exotherm rate of increase exceeding 50° F./hr.

3. A method according to claim 2 in which the exotherm is at least 100° F./hr.

4. A method according to claim 2 in which the zeolitic hydrocracking catalyst comprises zeolite Y.

5. A method according to claim 2 in which the zeolitic hydrocracking catalyst comprises zeolite USY.

* * * * *